US006227739B1

(12) United States Patent
Kageyama

(10) Patent No.: US 6,227,739 B1
(45) Date of Patent: May 8, 2001

(54) LIQUID CONTAINER

(75) Inventor: Hidehei Kageyama, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/632,162

(22) Filed: Aug. 3, 2000

(30) Foreign Application Priority Data

Apr. 21, 2000 (JP) ..... 12-120269

(51) Int. Cl.[7] ..... B43K 5/06
(52) U.S. Cl. ..... 401/172; 401/174; 401/194
(58) Field of Search ..... 401/172, 174, 401/173, 65, 66, 68, 74, 199

(56) References Cited

U.S. PATENT DOCUMENTS 5,085,352 * 2/1992 Sasaki et al. ..... 401/174
5,851,079 * 12/1998 Horstman et al. ..... 401/172
6,155,735 * 12/2000 Nakajima ..... 401/172

FOREIGN PATENT DOCUMENTS

258799 * 8/1987 (EP) ..... 401/172
2588733 * 4/1987 (FR) ..... 401/174

* cited by examiner

*Primary Examiner*—David J. Walczak
(74) *Attorney, Agent, or Firm*—McGinn & Gibb, PLLC

(57) ABSTRACT

A liquid container includes a body having a tank portion housing liquid, and a liquid supply port at a front side thereof, a piston moving forward inside the tank portion, a piston rod being integrally connected to the piston and extending rearward, the piston rod having an external thread formed in a periphery thereof, an operation cylinder being attached to a rear part of the body in a relatively rotatable fashion, a piston rod guide being adapted to be rotated integrally with the operating cylinder, the piston rod guide having an internal thread hole which is engaged with the external thread of the piston rod, and a ratchet cylinder being fixed in the rear inside the body, the ratchet cylinder having a bore through which the piston rod is pierced in a relatively unrotatable fashion. The operation cylinder is formed with serrated gear teeth at a front end thereof, and the ratchet cylinder is formed with a ratchet gear tooth which is brought into engagement with the serrated gear teeth and adopted to be selectively protruded or retracted in an axial direction, at a rear end thereof.

15 Claims, 5 Drawing Sheets

LIQUID CONTAINER

BACKGROUND OF THE INVENTION

1. Field of the Invention

The present invention relates to a liquid container which houses liquid, such as cosmetic liquid, writing ink, correcting liquid, etc. and, more particularly, to a liquid container which has a liquid supply port at its tip.

2. Description of the Related Art

A conventional container housing such kinds of liquid is shown, for example, by Japanese Utility Model Publication No. 6-14844. This conventional liquid container includes a tubular body having an applying liquid storage part formed inside, a screw rod disposed in a protruding fashion in a piston slidably fitted inside the storage part, and a rotation cylinder comprising an inner cylinder member and an outer cylinder member which are integrally bound. A ring protrusion and an engaging ratchet being elastic at the front portion in the axial direction are integrally formed on the outer cylinder member of the rotation cylinder. The ring protrusion is urged into and fitted to a ring groove at the rear end of the tubular body so that the rotation cylinder is rotatably joined with the tubular body.

Further, a ratchet structure is configured so that the engaging ratchet of the outer cylinder member is brought into elastomeric contact engagement with ratchet gear teeth integrally formed in the tubular body in an inner circumferential direction. A screw hole is provided in the inner cylinder member of the rotation cylinder so as to be threadably engaged in the screw rod. Two planar portions formed on both sides over the whole length of the screw rod are slidably fitted into a slide hole formed in a partition wall at a rear end of the storage portion of the tubular body. The screw rod moves forward without rotating with the rotation of the rotation cylinder so that the piston is pushed in the axial direction and the applying liquid is supplied.

As discussed above, the screw rod is slidably fitted into the slido hole formed in the partition wall at the rear end of the storage portion of the tubular body. Therefore, when the rotation cylinder rotates relative to the tubular body, a relative rotation between the inner cylinder member of the rotation cylinder and the screw rod is produced so that the fitting between the screw hole and the screw rod makes the screw rod move forward, thereby push-pressing the piston in the axial direction and supplying the applying liquid to the tip of the tubular body.

However, in the conventional liquid container, the partition wall must be provided at the rear end of the storage portion of the tubular body, and the slide hole for engagement fitting with the two planar portions of the screw rod must be formed in the partition wall. Moreover, the ratchet gear teeth must be integrally formed in the inner circumferential direction of the tubular body. Therefore, it is difficult to manufacture the tubular body by molding.

In addition, during assembly, the piston as well as the screw rod are inserted into the tubular body from a front side of the tubular body, the screw rod is put into the slide hole of the partition wall, the rotation cylinder is inserted into the tubular body from rearward of the tubular body, in such a manner that the screw rod is engaged with the inner cylindrical member of the rotation cylinder. Thus, assembly becomes difficult, and it is difficult to mass-produce the conventional liquid container.

SUMMARY OF THE INVENTION

In view of the foregoing and other problems, disadvantages, and drawbacks of the conventional liquid container, the present invention has been devised, and it is an object of the present invention to provide a liquid container which is molded, assembled, mass-produced, and put to practical use easily and efficiently.

In order to attain the above-described object, a liquid container according to the present invention includes a body having a tank portion for housing a liquid, and a liquid supply port at a front side thereof, a piston movable forwardly inside the tank portion, an operation cylinder being attached to a rear part of the body in a relatively rotatable fashion, a piston rod being disposed within an assembly comprising the body and the operation cylinder, the piston rod integrally connected to the piston and extending rearwardly, the piston rod being disposed within the assembly and adapted to be rotated integrally with the operation cylinder, the piston rod guide having an internal thread hole which is engaged with the external thread of the piston rod, and a ratchet cylinder being fixed in the rear inside of the body and having a bore through which the piston rod is pierced in a relatively unrotatable fashion. Serrated gear teeth are formed at a front end of the operation cylinder, and the ratchet gear tooth, which is brought into engagement with the serrated gear teeth and can selectively protrude or retract in the axial direction. The ratchet gear tooth is adopted to be selectively protruded or retracted in an axial direction upon the rotation of the operation cylinder relative to the body.

When the operation cylinder rotates relative to the body, the piston rod guide rotates integrally with the operation cylinder. On the other hand, the piston rod is unrotatably inserted through the ratchet cylinders fixed to the body and does not rotate. A relative rotation takes place between the piston rod guide and the piston rod so that thread engagement between the internal thread hole of the piston rod guide and the external thread of the piston rod causes the piston rod to move forwardly. Thus, the piston moves forwardly in the tank portion, and thus liquid inside the tank portion, which is pushed into the liquid supply port provided at the tip side of the body, can be supplied.

The serrated gear teeth formed at the front end of the operation cylinder are brought into engagement with the ratchet gear tooth formed in the ratchet cylinder so that the user experiences a feeling of control in operating the serrated gear teeth and the ratchet gear tooth, and also the operation cylinder is prevented from rotating in the opposite direction (e.g., a direction in which the piston moves rearwardly). The ratchet gear teeth which can protrude/retract in the axial direction, as well as the insertion through hole pierced by the piston rod, are formed in the ratchet cylinder and manufacturing thereof is easy.

In addition, assembly can be implemented by inserting into the body from the rear of the body the unit comprising the ratchet cylinder, the piston, the piston rod, the piston rod guide and the operation cylinder all together. Thus, these components are modular (e.g., unitary) so that assembly can be implemented easily.

The body may has an inner step portion formed on an inner peripheral surface thereof and the ratchet cylinder may have an outer step portion for contact with the inner step portion of the body. The container may includes a rotation preventive structure on the body and the ratchet cylinder for preventing relative rotation between the body and the ratchet cylinder.

The above-described rotation preventive structure may include a polygonal bore formed around the inner peripheral surface of the body and a polygonal outer peripheral surface formed around the outer peripheral surface of the ratchet cylinder. The polygonal bore of the body and polygonal outer peripheral surface of the ratchet cylinder are engaged with each other.

According to the present invention, the ratchet cylinder is preferably provided separately from the body so that not only ratchet gear teeth (which can protrude/retract in the axial direction) are formed at a rear end of the ratchet cylinder, but also a bore (into which a piston rod is inserted in a relatively unrotatable fashion) is formed. Thus, a liquid container can be provided which is excellent for molding, assembly mass production, and practical use, The present disclosure relates to subject matter contained in Japanese Patent Application 2000-120269, filed Apr. 21, 2000, which is expressly incorporated herein by reference in its entirety.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENT OF THE INVENTION

Figure 1:
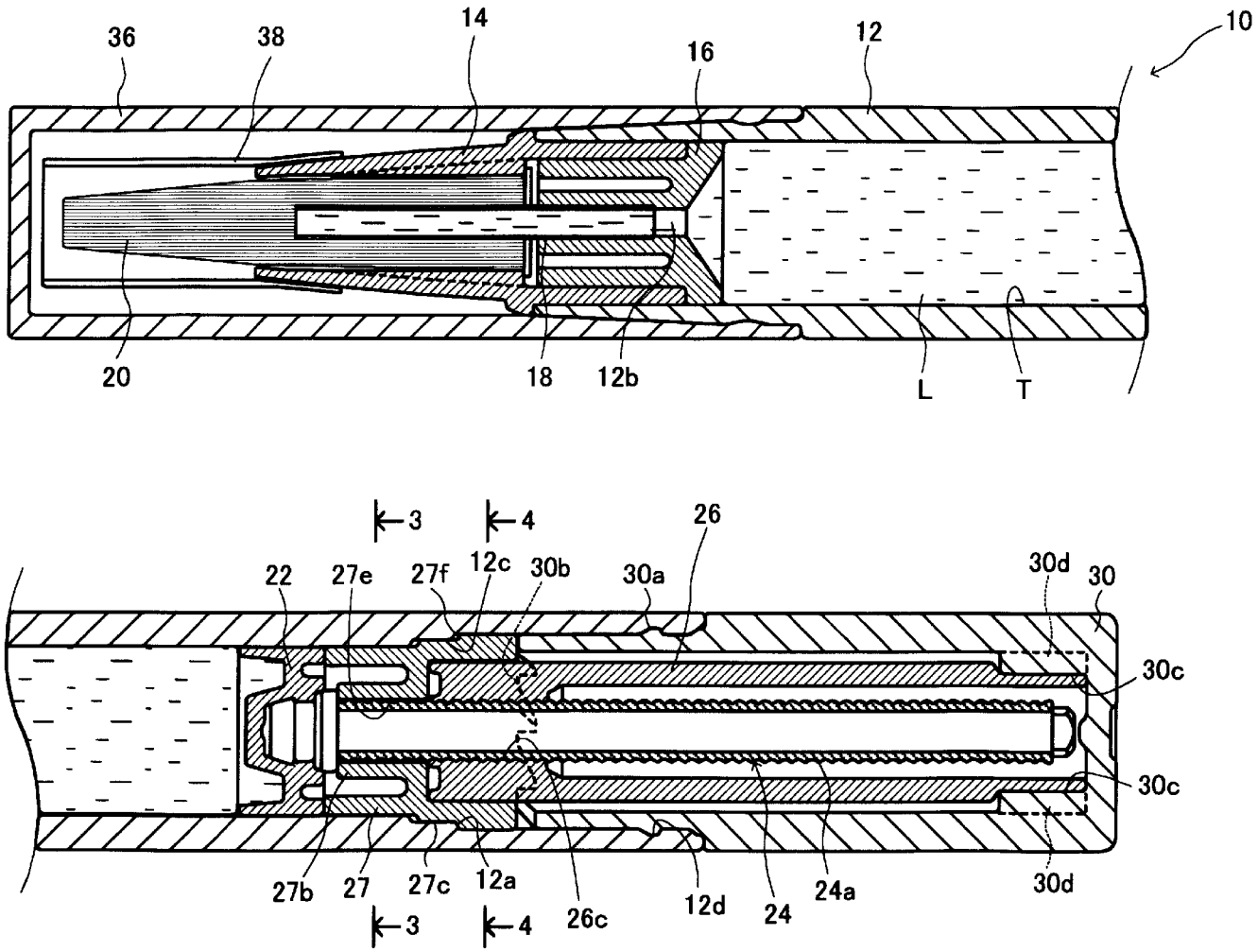
FIG. 1 is a top sectional view showing a preferred embodiment of a liquid container of the present invention; FIG, 2 is an exploded perspective view showing the main components in FIG. 1.

Referring now to the drawings, and more particularly to FIGS. 1–5, there is shown a preferred embodiment of the structure according to the present invention.

Referring to FIG. 1, a liquid container 10 includes a body 12 which has a tank portion T containing liquid L, for example, correction liquid, writing ink, cosmetic liquid, etc., and a liquid supplying port 12*b*. The liquid container 10 has a head part 14 fixed at the tip of the body 12, a pipe holder 16 fixed at the rear portion of the head part 14, a tip pipe 18 fixed to the pipe holder 16 so as to communicate with the liquid supplying port 12*b*, a brush (i e., liquid-applier member) 20, having a base fixed inside the head part 14, the tip of the tip pipe 18 being inserted into the base of the brush 20, a piston 22 slidably incorporated in the tank portion T, a piston rod 24 integrally connected to the piston 22 and extending rearwardly, the piston rod 24 having an external thread 24*a* provided on a periphery thereof, an operation cylinder 30 mounted in the rear portion of the body 12, a piston rod guide 26 having an internal thread hole 26*c* for receiving the external thread 24*a* of the piston rod 24 ( e.g., allowing the external thread 24*a* to be screwed in), and a ratchet cylinder 27 fixed rearwardly inside the body 12, the piston rod 24 being inserted through the ratchet cylinder 27.

In addition, at the tip of the body 12, a cap 36 to protect the brush 20 when it is not used is detachably attached, and moreover a cover 38 for protecting the liquid-applier member 20 is detachably attached to the tip portion of the head part 14 at the time of shipping so as to cover the liquid applier member 20.

On the frontal outer peripheral surface of the operation cylinder 30, a circular protrusion 30*a* is formed, and the circular protrusion 30*a* is fitted into a circular recess 12*d* formed on a rear inner peripheral surface of the body 12. Thus, the operation cylinder 30 is attached so as to be rotatable relative to the body 12.

Additionally, at a rear portion inside the operation cylinder 30, a plurality of vertical ribs 30*c* protruding radially inwardly are formed so that the space between adjacent vertical ribs 30*c* and 30*c* forms a vertical groove 30*d*.

Figure 2:
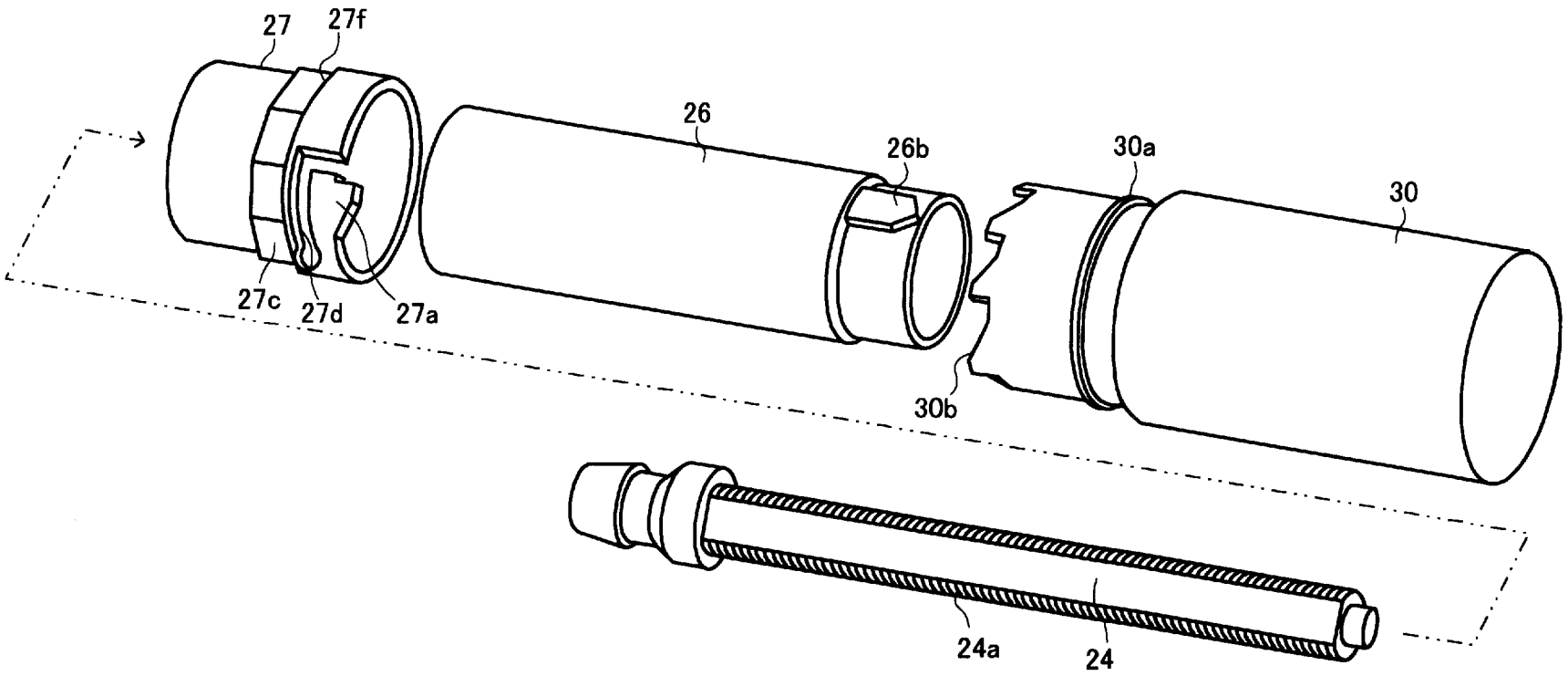

As shown in FIG. 2, vertical ribs 26*b* formed at a rear end of the piston rod guide 26 are fitted into vertical grooves 30*d*. Thus, the operational cylinder 30 and the piston rod guide 26 are arranged to rotate integrally, Moreover, as shown in FIG. 2, at a front end of the operation cylinder 30, serrated teeth 30*b* are formed. The serrated gear teeth 30*b* are brought into engagement with the ratchet gear tooth 27*a* which is formed at a rear end of the ratchet cylinder 27 and undergoes elastic deformation in an axial direction by an L-shaped slit 27*d* to protrude and retract.

Additionally, as shown in FIG. 2, the piston rod 24 has a non-circular shape when viewed in a cross-section (e.g., in this practical embodiment an oval shape). The ratchet cylinder 27 has an inner cylinder 27*b* formed therein (FIG. 1). the inner cylinder 27*b* has a bore 27*e* which has an oval shape corresponding with the cross-section shape of the piston rod 24.

Figure 3:
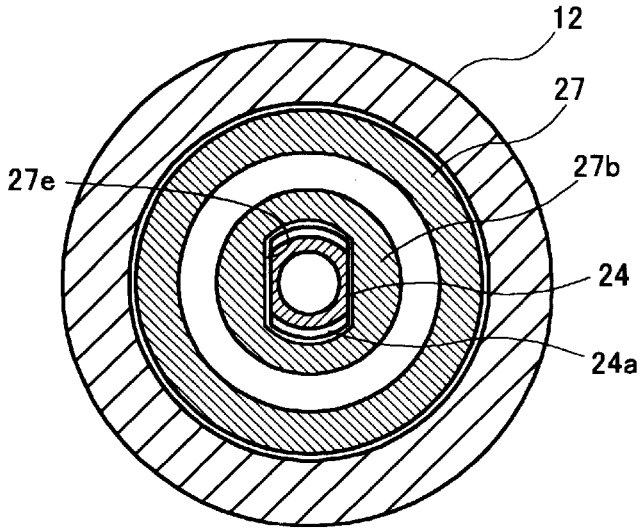
FIG. 3 is an end view along a line 3—3 in FIG. 1.

As shown in FIG. 3, the piston rod 24 is inserted through the bore 27*e* of the inner cylinder 27*b*, so that the piston rod 24 becomes non-rotatable relatively to the ratchet cylinder 27.

Figure 4:
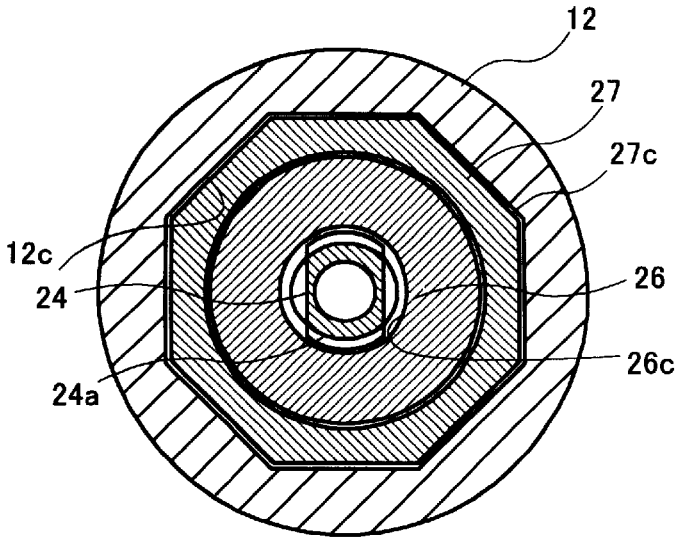
FIG. 4 is an end view along a line 4—4 in FIG. 1.

As shown in FIG. 4, a portion of an outer peripheral surface of the ratchet cylinder 27 is a polygonal outer peripheral surface 27*c*, which is engaged and fits with a polygonal bore 12*c* formed in a portion of inner peripheral surface of the body 12. The polygonal outer peripheral surface 27*c* and polygonal bore 12*c* form a structure prohibiting relative rotation therebetween, so that the ratchet cylinder 27 is unrotatable relative to the body 12. As a result, the piston rod 24 is unrotatable relative to the body 12. In addition, an outer step portion 27*f*, formed adjacent to the polygonal outer peripheral surface 27*c* of the ratchet cylinder 27 and facing forwardly, is brought into contact with an inner step portion 12*a* formed on the inner peripheral surface of the body 12 and facing rearwardly. The ratchet cylinder 27 is sandwiched between the inner step portion 12*a* of the body 12 and the serrated teeth 30*b* of the operation cylinder 30, and is fixed to the body 12.

To assemble the liquid container 10, first, the tip of the piston rod 24 is press-fitted into the piston 22, the ratchet cylinder 27 is mounted on the piston rod 24 inserted from the rear end of the piston rod 24, the piston rod guide 26 is mounted on the piston rod 24, and the external thread 24*a* of the piston rod 24 is screwed into the internal thread hole 26*c* of the piston rod guide 26, Then, the piston rod guide 26 is inserted into the operation cylinder 30 so that the vertical rib 26*b* of the piston rod guide 26 is inserted into the vertical groove 30*d* of the operational cylinder 30. Thus, an assembly unit which comprises the piston 22, the piston rod 24, the piston rod guide 26, the ratchet cylinder 27 and the operation cylinder 30 is produced.

Next, the above-described assembly unit is inserted from a rear end mouth of the body 12 into the body 12, the polygonal outer peripheral surface 27*c* of the ratchet cylinder 27 is engaged with the polygonal bore 12*c* of the body 12, and the assembly unit is pushed until the outer step portion 27*f* of the ratchet cylinder 27 contacts the inner step portion 12*a* of the body 12. Then, the circular protrusion 30*a* of the operation cylinder 30 is fitted into the circular recess 12*d* of the body 12 so that the body 12 and the assembly unit are fixed.

In addition, the tip pipe 18 is press-fitted into the pipe holder 16, thereby producing a combination which comprises the pipe holder 16 and the tip pipe 18. In addition, the cover 38 is attached to the bead part 14 to protect the head of the brush 20. The brush 20 is inserted from a rear end of the head part 14 into the head part 14. The combination produced as described above is press-fitted into the head part 14 in such a manner that the tip pipe 18 is pierced or inserted into a hole created in the center of the brush 20, to thereby produce a head part unit which comprises the head part 14, the pipe holder 16, the tip pipe 18, and the brush 20.

Lastly, the liquid L is injected into the body 12 from the tip mouth of the body 12. The head part unit is press-fitted into the body 12 for fixation, and is covered with the cap 36 for completion.

When the above liquid container 10 is used, the cap 36 and the cover 38 are removed so that the brush 20 can be used for application of the liquid L. If the liquid must be further supplied from the brush 20, the operation cylinder 30 is rotated relative to the body 12.

Figure 5:
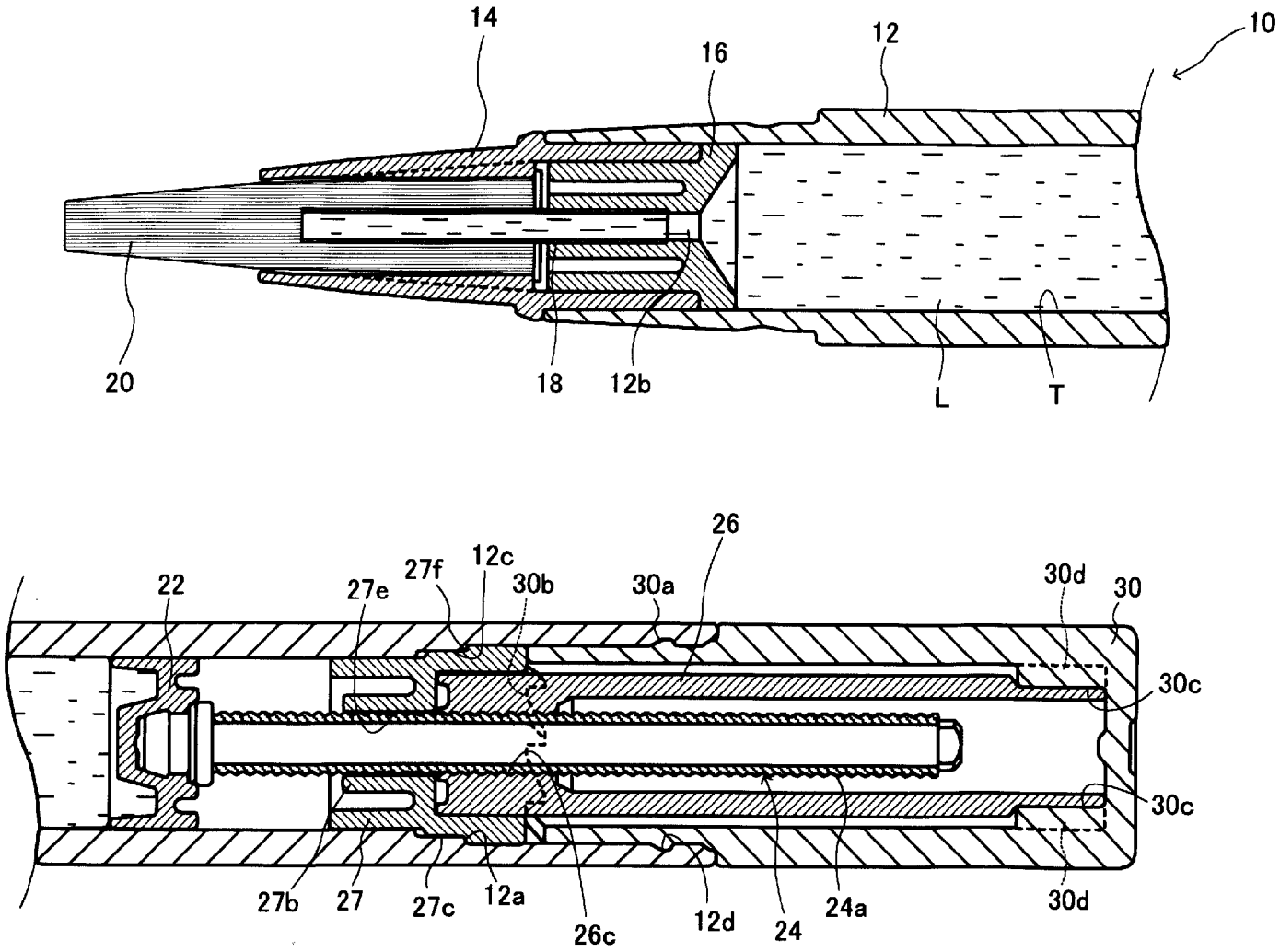
FIG. 5 is a top sectional view showing how a piston moves forward from the liquid container in FIG. 1.
Figure 6:
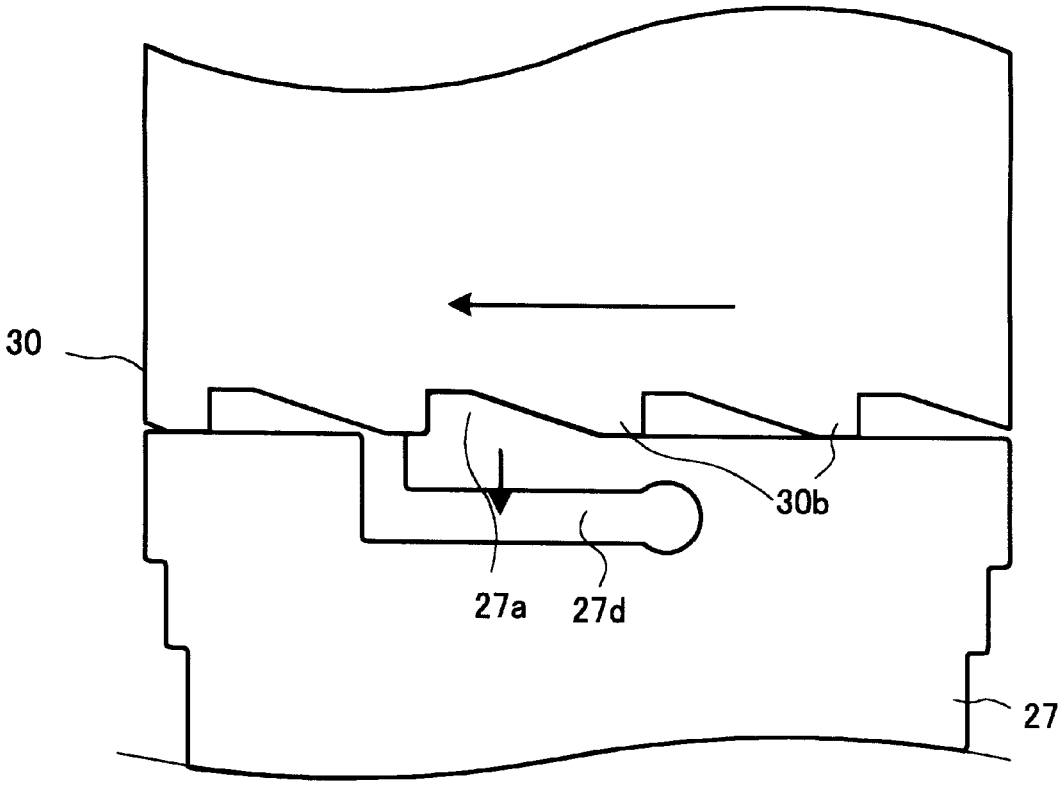
FIG. 6 is a partially spread (e.g., unfolded) view showing the relationship between a ratchet cylinder and sawteeth of a operation cylinder of the liquid container in FIG. 1.

Referring to FIGS. 5 and 6, the operation of the liquid container 10 will be discussed hereinafter. When the operation cylinder 30 is rotated relative to the body 12, the piston rod guide 26 is rotated together with the operation cylinder 30. In contrast, the piston rod 24, fitted into the bore 27*e* of the ratchet cylinder 27 fixed to the body 12, does not rotate. Thus, a relative rotation between the piston rod guide 26 and the piston rod 24 occurs, and a thread engagement between the internal thread hole 26*c* of the piston rod guide 26 and the external thread 24*a* of the piston rod 24 causes the piston rod 24 to move forwardly. As the piston 22 moves forwardly in the tank portion T, the liquid L inside the tank portion T is pushed to the supply port 12*b* provided at the tip side of the body 12 and passes through the tip pipe 18 to be supplied to the brush 20. Thus, the liquid L is available for use.

As shown in FIG. 6, during the rotation of the operation cylinder 30, the serrated teeth 30*b* of the operation cylinder 30 runs over and down a slope of the ratchet gear tooth 27*a* of the ratchet cylinder 27 while causing the ratchet gear tooth 27*a* to be retracted and protruded. Protrusion/retraction of the ratchet gear tooth 27*a* creates a click sound so that a user can experience a feeling of control. In addition, when the user inadvertently tries to rotate the operation cylinder 30 in the reverse direction, the serrated teeth 30*b* of the operation cylinder 30 and the ratchet gear tooth 27*a* of the ratchet cylinder 27 are brought into engagement so that relative movement between the operation cylinder 30 and the ratchet cylinder 27 is prevented, and therefore the operation cylinder 30 cannot rotate. Accordingly, the operation cylinder 30 rotates only in a direction such that the piston 22 moves forwardly in the tank portion T.

Incidentally, FIG. 5 depicts the condition in which the liquid L is consumed and the piston 22 moves forwardly, and in accordance with the decrease in the liquid L due to usage, the piston 22 moves forwardly inside the body 12.

As described above, this embodiment is provided with the ratchet cylinder 27, and the ratchet gear tooth 27*a* which protrudes and retracts in the axial direction is formed for the ratchet cylinder 27. Additionally, although the bore 27*e* of the inner cylinder portion 27*b* is formed in such a manner that the piston rod 24 is fitted into the bore 27*e*, such a ratchet cylinder 27 can be molded easily. On the other hand, for the body 12, such a ratchet gear tooth or an insertion through hole, for inserting the piston rod 24 in a relatively unrotatable fashion need not be formed. Thus, the body 12 can be easily molded with a good yield factor.

In addition, as described above, assembly can be easily implemented by inserting into the body 12 from the rear of the body 12 the unit including the piston 22, the piston rod 24, the ratchet cylinder 27, the piston rod guide 26 and the operation cylinder 30.

While the invention has been described in terms of a preferred embodiment, those skilled in the art will recognize that the invention can be practiced with modification within the spirit and scope of the appended claims.

What is claimed is:

1. A liquid container comprising:

a body having a tank portion housing liquid, and a liquid supply port at a front side thereof;

a piston movable forwardly inside the tank portion;

an operation cylinder being attached to a rear part of the body in a relatively rotatable fashion;

a piston rod being disposed within an assembly comprising the body and the operation cylinder, the piston rod integrally connected to the piston and extending rearwardly, the piston rod having an external thread formed in a periphery thereof;

a piston rod guide being disposed within the assembly and adapted to be rotated integrally with the operation cylinder, the piston rod guide having an internal thread hole which is engaged with the external thread of the piston rod; and a ratchet cylinder being fixed in the rear inside the body, the ratchet cylinder having a bore through which said piston rod is inserted in a relatively unrotatable fashion;

wherein the operation cylinder includes serrated gear teeth formed at a front end thereof, and the ratchet cylinder includes a ratchet gear tooth formed at a rear end thereof, the ratchet gear tooth being brought into engagement with said serrated gear teeth and adapted to be selectively protruded or retracted in an axial direction upon the rotation of the operation cylinder relative to the body.

2. The liquid container according to claim 1, wherein said body has an inner step portion formed on an inner peripheral surface thereof and said ratchet cylinder has an outer step portion for contact with the inner step portion of the body, and wherein said container further includes a rotation preventive structure on the body and the ratchet cylinder for preventing relative rotation between the body and the ratchet cylinder.

3. The liquid container according to claim 2, wherein said rotation preventive structure includes a polygonal bore formed around the inner peripheral surface of the body and a polygonal outer peripheral surface formed around the outer peripheral surface of the ratchet cylinder, said polygonal bore and said polygonal outer peripheral surface being engaged with each other.

4. The liquid container according to claim 1, wherein the internal thread hole of said piston rod guide and the external thread of the piston rod are engaged with each other and said piston rod moves forwardly during relative rotation between said piston rod guide and said piston rod, and wherein the liquid inside the tank portion is pushed into the liquid supply port as said piston rod moves forwardly.

5. The liquid container according to claim 1, wherein said ratchet cylinder is provided separately from the body.

6. A liquid container comprising:

a housing containing liquid, said housing comprising a liquid supply port; and a liquid supplying unit for pushing said liquid through said supply port, wherein said liquid supplying unit comprises a piston movable in a first direction, a piston rod being integrally brought into connection with the piston, an operation cylinder being attached to the liquid housing in a relatively rotatable fashion, and a ratchet cylinder being fixed inside the liquid housing, said ratchet cylinder having a bore through which said piston rod is inserted in a relatively unrotatable fashion, wherein the operation cylinder is formed with gear teeth, and the ratchet cylinder is formed with a ratchet gear tooth which is brought into engagement with said gear teeth and adapted to be selectively protruded or retracted upon the rotation of the operation cylinder relative to the body.

7. The liquid container, according to claim 6, wherein the piston rod has an external thread in a periphery thereof and a piston rod guide has an internal thread hole which is engaged with the the external thread of the piston rod, said piston rod guide integrally rotating with the operation cylinder.

8. The liquid container, according to claim 7, wherein said house has an inner step portion formed on an inner peripheral surface thereof and said ratchet cylinder has an outer step portion for contact with the inner step portion of the house, and wherein said container further includes a rotation preventive structure on the house and the ratchet cylinder for preventing relative rotation between the house and the ratchet cylinder.

9. The liquid container, according to claim 8, wherein said rotation preventive structure includes a polygonal bore formed around the inner peripheral surface of the house and a polygonal outer peripheral surface formed around the outer peripheral surface of the ratchet cylinder, said polygonal bore and said polygonal outer peripheral surface being engaged with each other.

10. A liquid container, comprising;

a body having a tank portion containing a liquid, and a liquid supply port;

a piston located inside the tank portion;

piston rod connected to the piston, and including an external thread formed in a periphery thereof;

an operation cylinder attached to the body in a relatively rotatable fashion;

a piston rod guide having an internal thread hole which is engaged with the external thread of the piston rod, said piston rod guide integrally rotating with the operation cylinder; and a ratchet cylinder fixedly located inside the body, and coupled to said piston rod in a relatively unrotatable fashion, wherein said operation cylinder includes gear teeth formed at a front end thereof, and the ratchet cylinder includes a ratchet gear tooth formed at a rear end thereof, and wherein said ratchet gear tooth is brought into engagement with said gear teeth and adopted to be selectively protruded or retracted in the axial direction upon the rotation of the operating cylinder relative to the body.

11. The liquid container according to claim 10, wherein said body has an inner step portion formed on an inner has peripheral surface thereof and said ratchet cylinder has an outer step portion contactable with the inner step portion of the body, and wherein said liquid container further includes a rotation preventive structure on the body and the ratchet cylinder for preventing relative rotation between the body and the ratchet cylinder.

12. The liquid container according to claim 11, wherein said rotation preventive structure comprises a polygonal bore formed around the inner peripheral surface of the body and a polygonal outer peripheral surface formed around the outer peripheral surface of the ratchet cylinder, said polygonal bore and said polygonal outer peripheral surface being engaged with each other.

13. The liquid container according to claim 12, wherein the internal thread hole of said piston rod guide and the external thread of the piston rod are engaged with each other and said piston rod moves forward during relative rotation between said piston rod guide and said piston rod, and wherein liquid inside the tank portion is pushed into the liquid supply port at a tip side of the body as said piston rod moves forward.

14. The liquid container according to claim 13, wherein said ratchet cylinder is provided separately from the body.

15. The liquid container according to claim 14, wherein said ratchet cylinder is formed with a bore into which said piston rod is inserted in a relatively unrotatable fashion.

* * * * *